US009200394B2

(12) United States Patent
Tseng

(10) Patent No.: US 9,200,394 B2
(45) Date of Patent: Dec. 1, 2015

(54) GUIDING STRUCTURE FOR A CLOTH FEEDING MECHANISM

(76) Inventor: Hsien-Chang Tseng, Ta-Li (TW)

( * ) Notice: Subject to any disclaimer, the term of this patent is extended or adjusted under 35 U.S.C. 154(b) by 1109 days.

(21) Appl. No.: 13/235,448

(22) Filed: Sep. 18, 2011

(65) Prior Publication Data

US 2013/0068146 A1 Mar. 21, 2013

(51) Int. Cl.
*D05B 27/00* (2006.01)
*D05B 27/02* (2006.01)

(52) U.S. Cl.
CPC ..... *D05B 27/02* (2013.01)

(58) Field of Classification Search
CPC ..... D05B 27/02
USPC ..... 112/303, 317, 324
See application file for complete search history.

(56) References Cited

U.S. PATENT DOCUMENTS 3,921,552 A * 11/1975 Daman et al. ..... 112/323
4,512,273 A * 4/1985 Skogward ..... 112/315
5,070,800 A * 12/1991 Iwata ..... 112/311
5,477,796 A * 12/1995 Nedoschinsky et al. ..... 112/323

* cited by examiner

*Primary Examiner* — Nathan Durham
(74) *Attorney, Agent, or Firm* — Patent Office of Bang Shia

(57) ABSTRACT

A guiding structure for a cloth feeding mechanism which is disposed on a base below a needle plate of a sewing machine, a feeding dog driven by the cloth feeding mechanism is mounted on a mounting seat. The guiding structure comprising a first guiding portion formed on the mounting seat and a second guiding portion formed on a guiding device, the first and second guiding portions cooperate with each other to guide the feeding dog to move in the X-axis direction, so that the cloth can be fed precisely along the predetermined path to ensure good sewing quality.

3 Claims, 8 Drawing Sheets

GUIDING STRUCTURE FOR A CLOTH FEEDING MECHANISM

BACKGROUND OF THE INVENTION

1. Field of the Invention

The present invention relates to a guiding structure for a cloth feeding mechanism capable of guiding the feeding dog of a cloth feeding mechanism to move precisely without the problem of deviation, thus improving the sewing quality.

2. Description of the Prior Art

Sewing operation of a sewing machine is such that the feeding dog of a cloth feeding mechanism moves the cloth forward or backward at a high speed along the X-axis direction, while the needle sews the designed patterns on the cloth. The feeding dog is located at the end of the cloth feeding mechanism, the cloth is likely to slant toward the Y-axis direction and unable to move precisely along the X-axis direction, when fed by the feeding dog due to the manufacturing or assembling tolerance of the cloth feeding mechanism, resulting in bad sewing quality.

The present invention has arisen to mitigate and/or obviate the afore-described disadvantages.

SUMMARY OF THE INVENTION

The primary object of the present invention is to provide a guiding structure for a cloth feeding mechanism which is disposed on a base below a needle plate of a sewing machine, a feeding dog driven by the cloth feeding mechanism is mounted on a mounting seat. The guiding structure comprising a first guiding portion formed on the mounting seat and a second guiding portion formed on a guiding device, the first and second guiding portions cooperate with each other to guide the feeding dog to move in the X-axis direction, so that the cloth can be fed precisely along the predetermined path to ensure good sewing quality.

Another object of the present invention is to provide a guiding structure for a cloth feeding mechanism, wherein the guiding device comprises an adjusting member disposed on the base, the adjusting member is eccentrically formed with the second guiding portion to be engaged with the first guiding portion of the feeding dog, the first guiding portion can be used to micro-adjust the cloth feeding mechanism to prevent error accumulation in the motion of the feeding dog, and thus sewing quality can be ensured.

A positioning member is vertically arranged with respect to the adjusting member and is screwed to position the adjusting member.

Yet, another object of the present invention is to provide a guiding structure for a cloth feeding mechanism, wherein the first and second guiding portions can exchange positions with each other.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
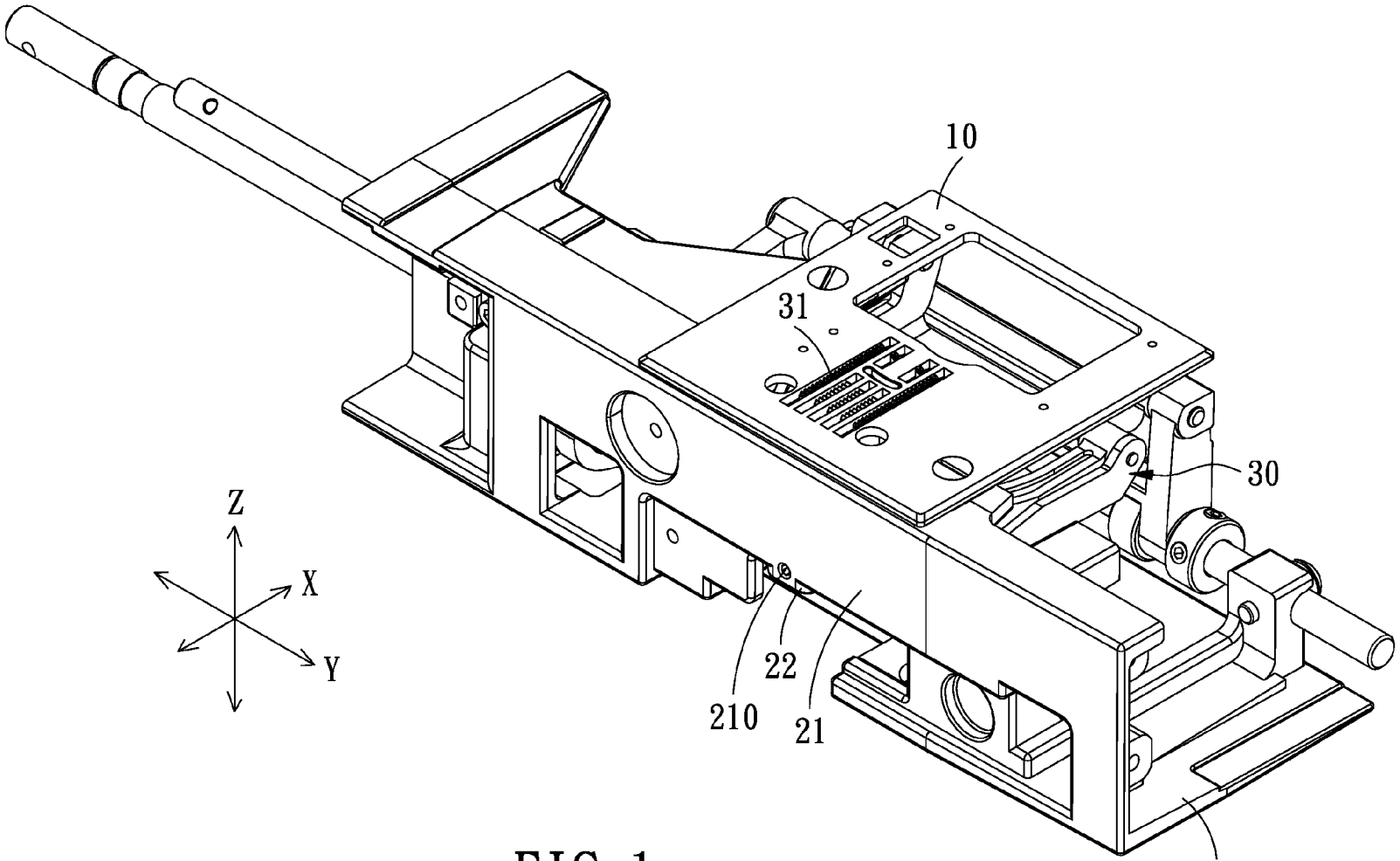
FIG. 1 is a perspective view of a cloth feeding mechanism in accordance with a first embodiment of the present invention.
Figure 2:
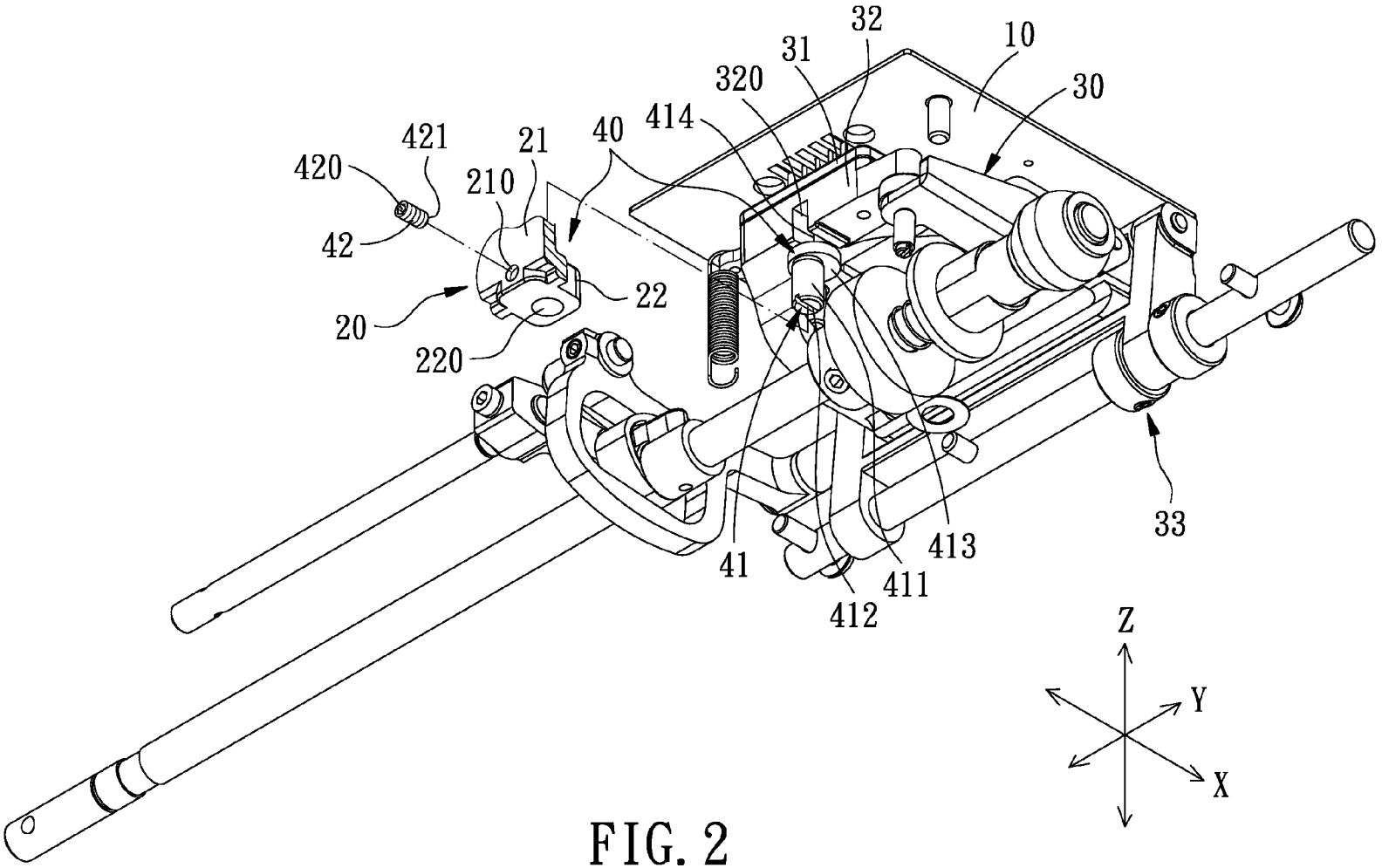
FIG. 2 is a first-angle of exploded view of the cloth feeding mechanism in accordance with the first embodiment of the present invention.
Figure 3:
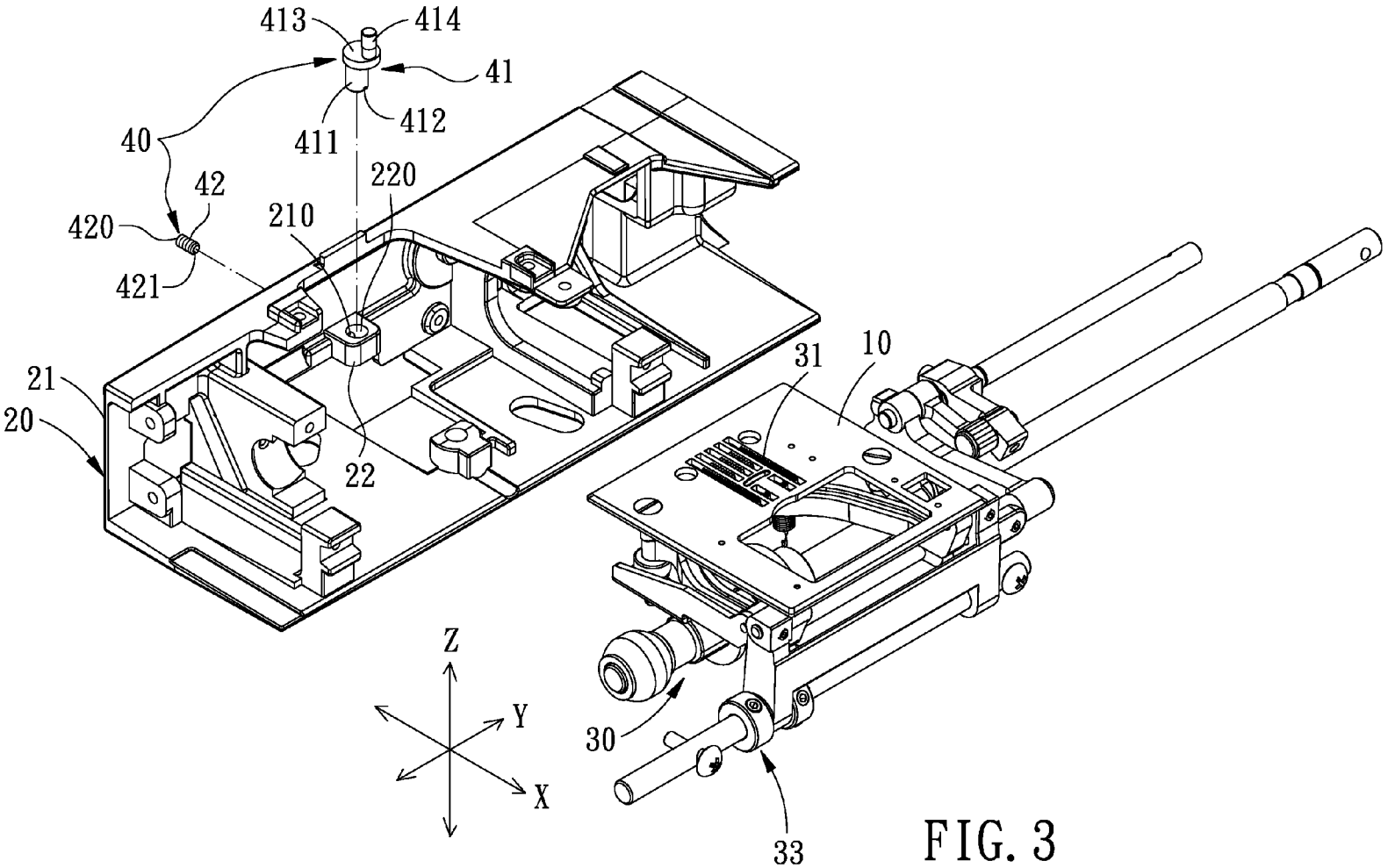
FIG. 3 is a second-angle of exploded view of the cloth feeding mechanism in accordance with the first embodiment of the present invention.

Referring to FIGS. 1-3, a cloth feeding mechanism 30 in accordance with the present invention is disposed on a base 20 below a needle plate 10 of a sewing machine. A feeding dog 31 driven by the cloth feeding mechanism 30 is located in a slot of the needle plate 10 and mounted on a horizontal mounting seat 32 which has two ends connected to a feeding rod assembly 33. The feeding rod assembly 33 is a conventional structure, so no further description seems necessary. The direction in which the feeding dog 31 horizontally moves the cloth back and forth is defined as X-axis direction, and the direction in which the feeding dog 31 vertically moves is defined as Z-axis direction which is vertical to the X-axis direction, and a direction in which the feeding dog 31 horizontally deviates left and right is defined as a Y-axis direction.

A guiding device 40 is mounted on the base 20 to guide the feeding dog 31 of the cloth feeding mechanism 30 to move in the X-axis direction without deviating in the Y-axis direction while allowing the feeding dog 31 to be adjusted in the Z-axis direction.

The mounting seat 32 is formed at the center of a bottom thereof with a first guiding portion 320 which has a depth greater than a distance in the Z-axis direction that the feeding dog 31 is allowed to move.

The base 20 includes a wall 21 extending in the Z-axis direction and a positioning portion 22 on the wall 21. In the wall 21 is defined a positioning hole 210 which is formed with an inner thread and in communication with an adjusting hole 220 extending in the Z-axis direction and formed at the center of the positioning portion 22.

The guiding device 40 includes an adjusting member 41 and a positioning member 42. The adjusting member 41 includes an adjusting portion 411 in the form of a rod partially inserted in the adjusting hole 220, and in one end of the adjusting portion 411 exposed out of the adjusting hole 220 is formed an adjusting end 412 which can be rotated by a slot driver. Another end of the adjusting portion 411 extending out of the adjusting hole 220 is formed with an annular positioning portion 413 on which being eccentrically formed a protruding second guiding portion 414 to be engaged in the first guiding portion 320 of the mounting seat 32. Rotating the adjusting portion 411 with a slot driver can change the position of the second guiding portion 414, and consequentially adjust the mechanical errors caused by the feeding rod assembly 33 through the engagement of the second guiding portion 414 with the first guiding portion 320. Once adjustment is done, the positioning member 42 can be used to fix the adjusting member 41 in the adjusted position and prevent the adjusting member 41 from rotating.

The positioning member 42 is provided with out thread and screwed in the positioning hole 210, one end of the positioning member 42 exposed out of the positioning hole 210 is a driven end 420 in the form of a hexagonal concave to be engaged with and rotated by a hexagonal tool, while another end of the positioning member 42 is a conical push end 421 which is inserted in the adjusting hole 220 to push against the adjusting member 41 so as to fix the adjusting member 41 and prevent it from rotating.

Figure 4:
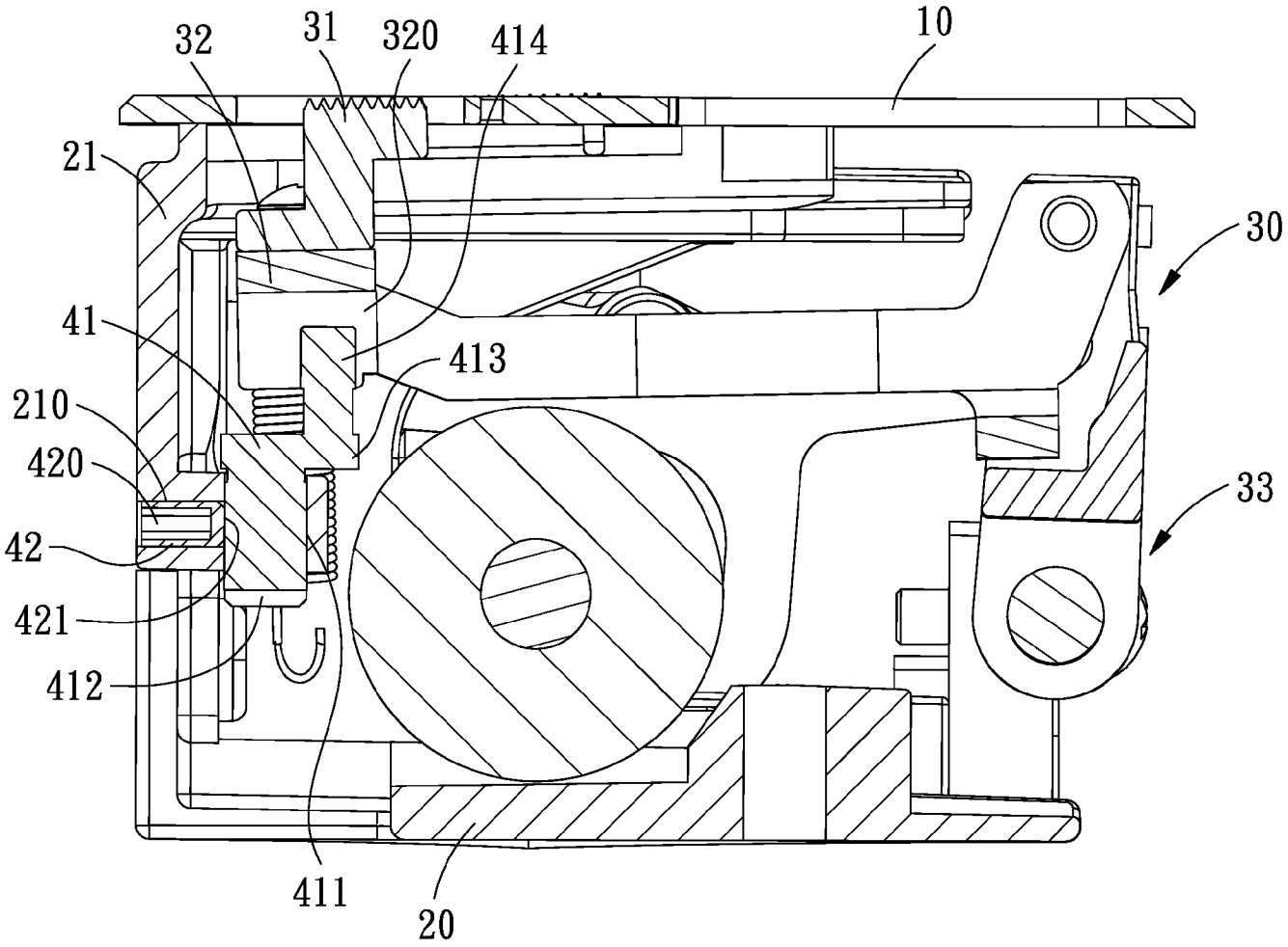
FIG. 4 is a cross sectional view of the cloth feeding mechanism in accordance with the first embodiment of the present invention.
Figure 5:
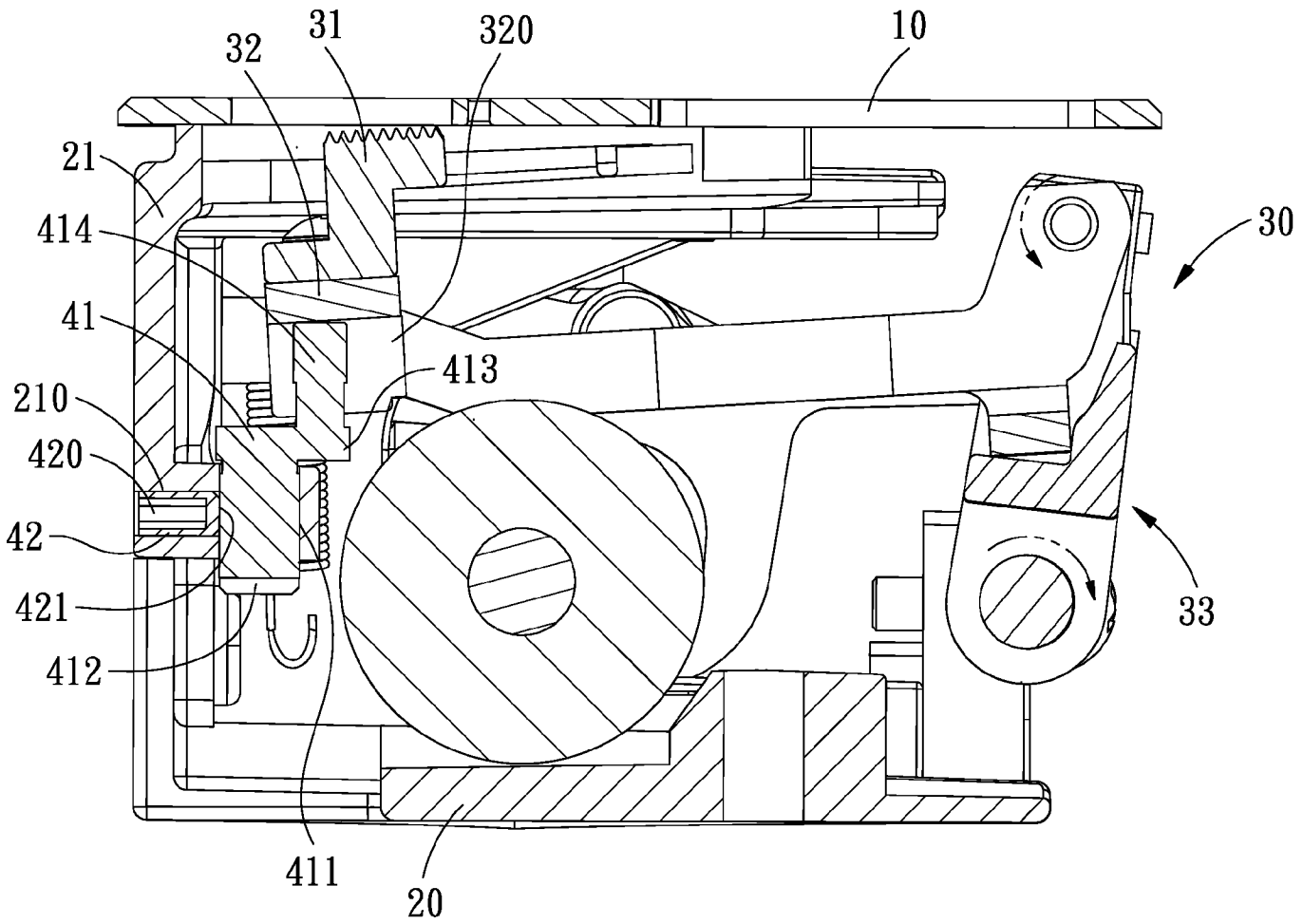
FIG. 5 is an operational view of the cloth feeding mechanism in accordance with the first embodiment of the present invention.

The present invention has the following advantages:

1. precise guiding: the guiding device 40 can keep the feeding dog 31 and the mounting seat 32 in the optical path, with reference to FIGS. 4 and 5, no matter the feeding dog 31 is in any position of its feeding travel, the second guiding portion 414 of the adjusting member 41 is always engaged in the first guiding portion 320 to provide a guiding function to prevent the deviation of the feeding dog 31 in the Y-axis direction, thus the sewing quality will be good.

2. high adjustability: the second guiding portion 414 and the adjusting portion 411 of the adjusting member 41 are eccentric each other, so that rotating the adjusting portion 411 can cause a relatively large displacement of the second guiding portion 414, and thus the adjustment is easy and quick.

3. simple structure: the guiding device 40 consisting of only an adjusting member 41 and a positioning member 42 is simply structured and easy to operate.

Figure 6:
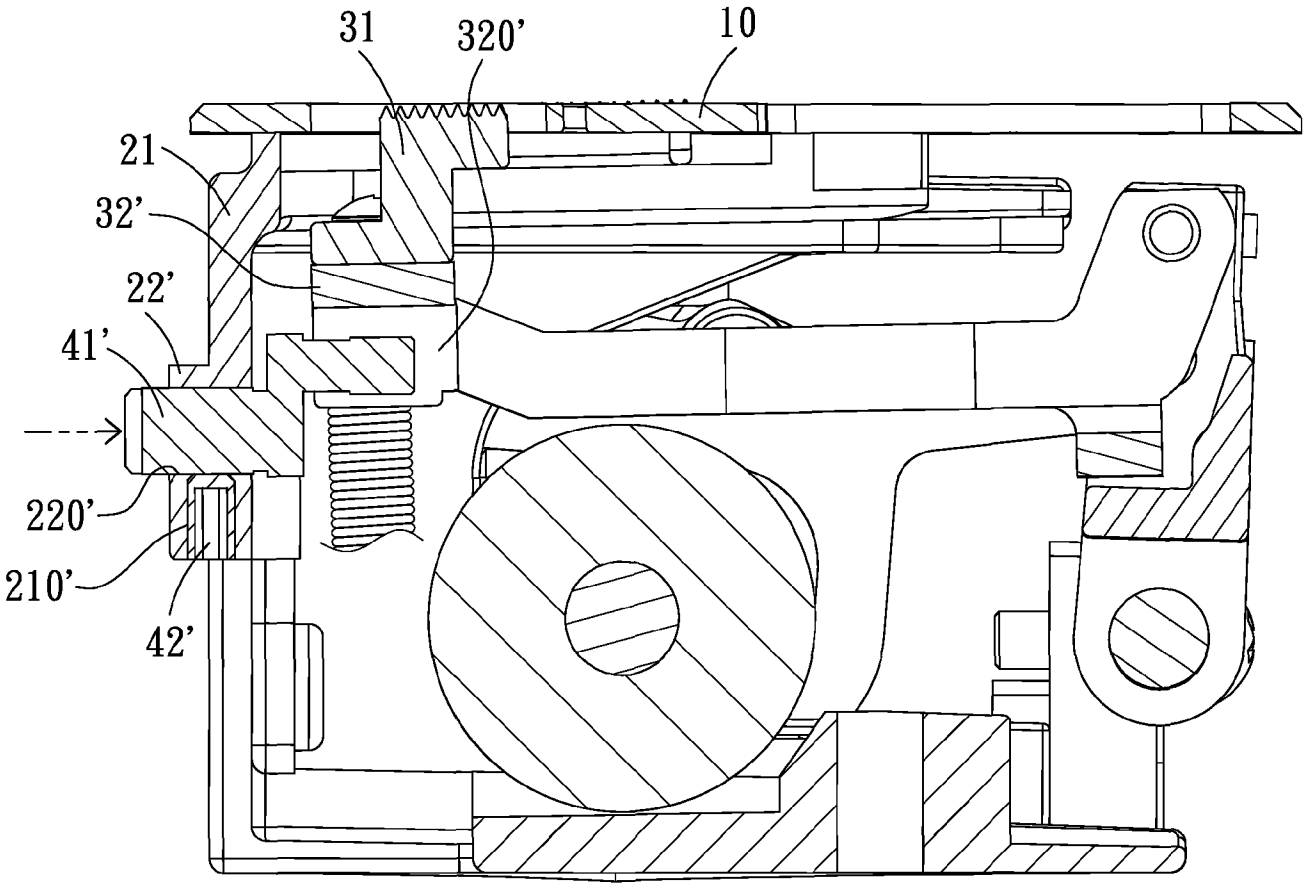
FIG. 6 is a cross sectional view of the cloth feeding mechanism in accordance with a second embodiment of the present invention.

Referring then to FIG. 6, a second embodiment is shown, wherein the first guiding portion 320' is located at the bottom of the mounting seat 32 of the feeding dog 31, the axis of the adjusting member 41' of the guiding device 40' is located in the X-axis direction, the positioning member 42' is located in the Z-axis direction, and the positioning hole 210' and adjusting hole 220' of the base 20 exchange positions with each other.

Figure 7:
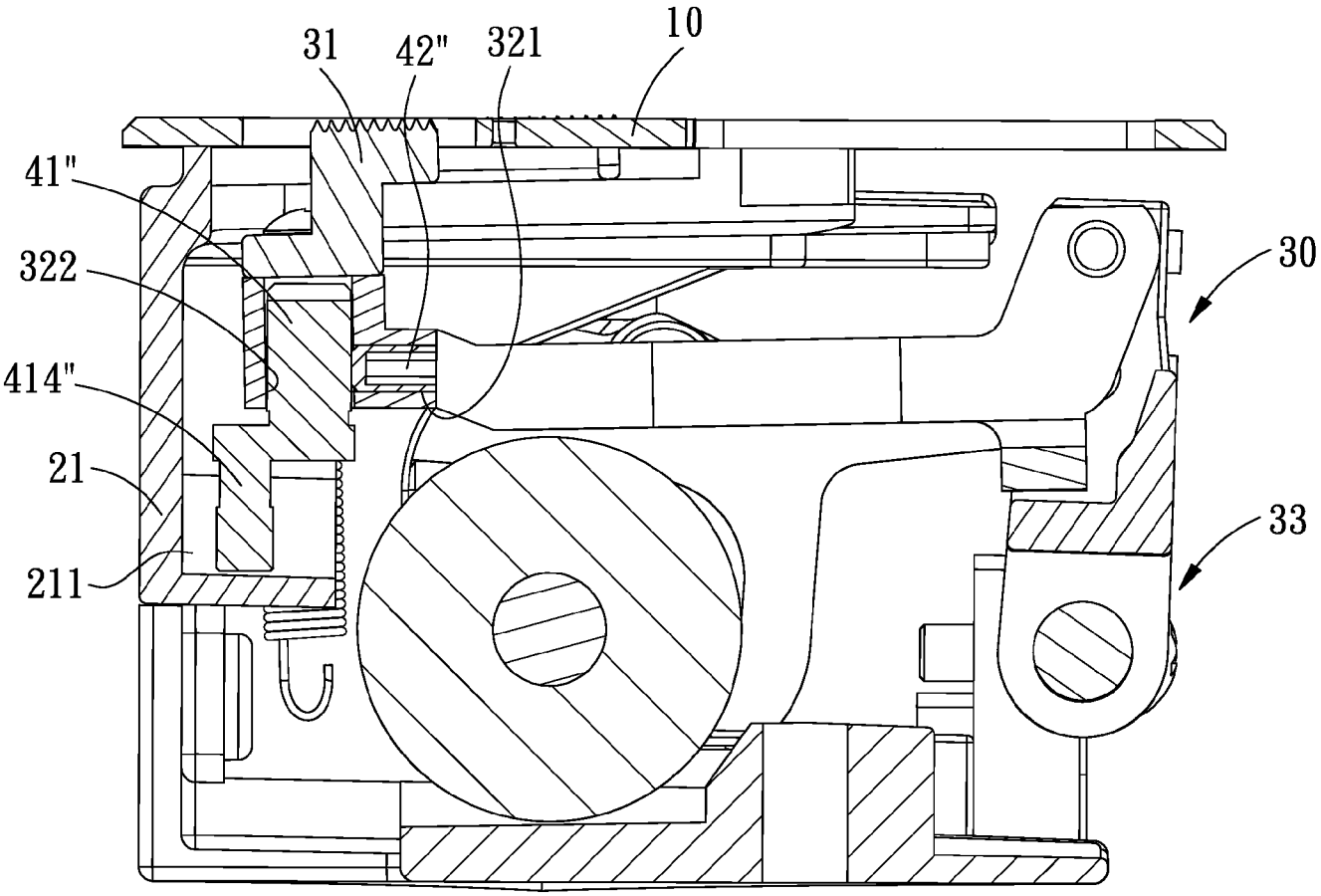
FIG. 7 is a cross sectional view of the cloth feeding mechanism in accordance with a third embodiment of the present invention.

A third embodiment is shown in FIG. 7, wherein the mounting seat 32 is formed with a positioning hole 321 in the X-axis direction and an adjusting hole 322 in communication with and vertical to the end of the positioning hole 321. The guiding device 40" includes an adjusting member 41" to be screwed in the adjusting hole 322 and a positioning member 42" to be screwed in the positioning hole 321. The adjusting member 41" and the positioning member 42" are structurally the same as the previous embodiments. One end of the adjusting member 41" is eccentrically formed with a second guiding portion 414", the wall 21 of the base 20 is formed with a first guiding portion 211 which is a groove extending in the X-axis direction for engaging with the second guiding portion 414", and the first guiding portion 211 has a depth greater than a distance in the Z-axis direction that the feeding dog 31 is allowed to move.

Figure 8:
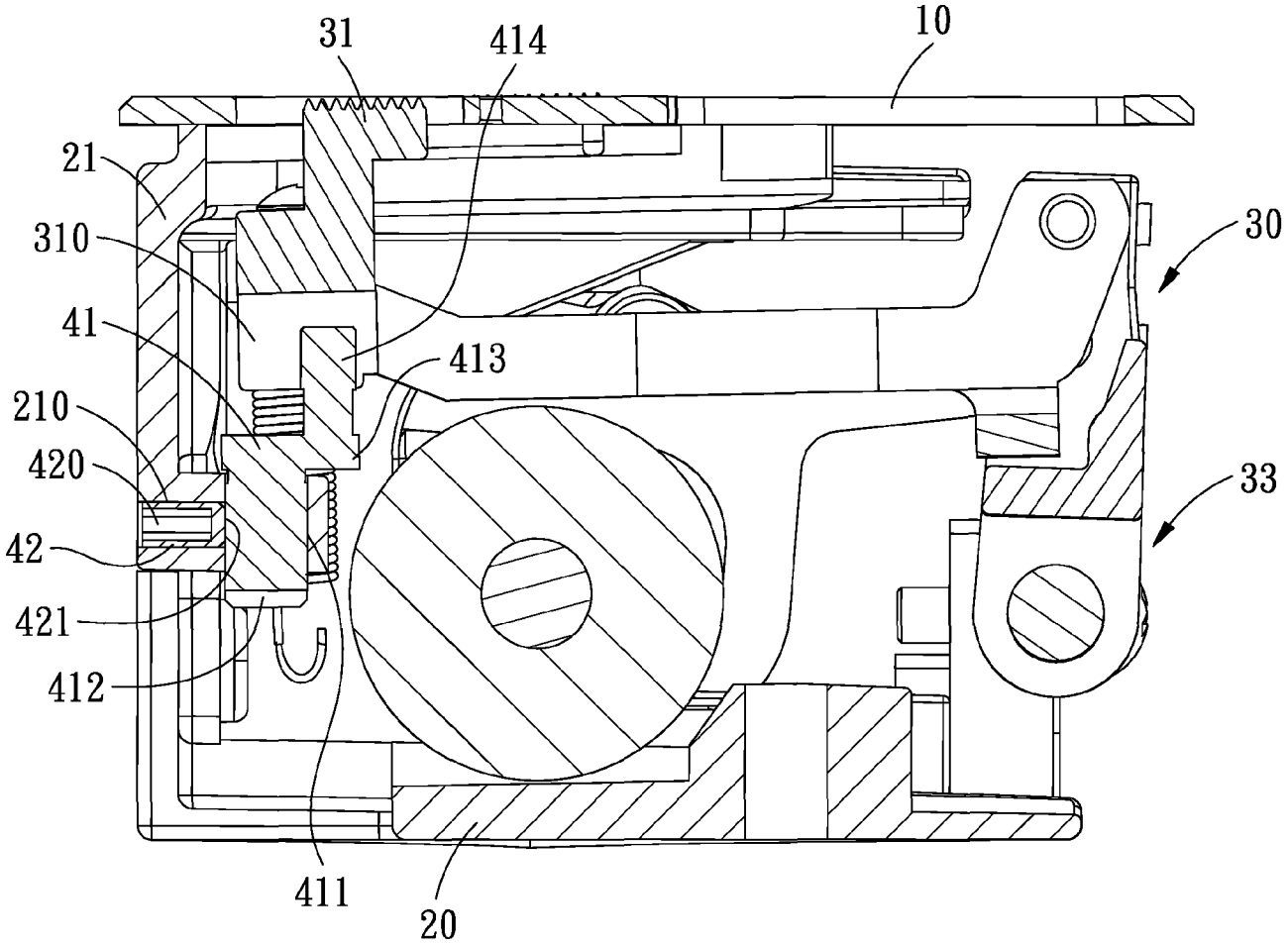
FIG. 8 is a cross sectional view of the cloth feeding mechanism in accordance with a fourth embodiment of the present invention.

A fourth embodiment is shown in FIG. 8, wherein the first guiding portion 310 or the second guiding portion of the guiding device can be formed on the feeding dog 31.

While we have shown and described various embodiments in accordance with the present invention, it is clear to those skilled in the art that further embodiments may be made without departing from the scope of the present invention.

What is claimed is:

1. A guiding structure for a cloth feeding mechanism disposed on a base below a needle plate of a sewing machine, a feeding dog mounted on a mounting seat which is driven by the cloth feeding mechanism to move back and forth in an X-axis direction;

the guiding structure comprising a first guiding portion formed on the mounting seat and a second guiding portion formed on a guiding device, the first and second guiding portions cooperate with each other to guide the feeding dog to move in the X-axis direction;

wherein the first guiding portion is mounted on the mounting seat, and the second guiding portion is mounted on the base;

the first guiding portion is a groove extending in the X-axis direction and has a depth greater than a distance in the Z-axis direction that the feeding dog is allowed to move, the base includes a wall extending in the Z-axis direction and a positioning portion on the wall, in the wall is defined a positioning hole which is formed with an inner thread and in communication with an adjusting hole extending in a Z-axis direction, the adjusting member is inserted in the guiding hole, and the positioning member is inserted in the positioning hole.

2. The guiding structure for a cloth feeding mechanism as claimed in claim 1, wherein the guiding device comprises an adjusting member disposed on the base, one end of the adjusting portion is formed with an adjusting end which is to be adjusted, and another end of the adjusting portion is formed with the second guiding portion.

3. The guiding structure for a cloth feeding mechanism as claimed in claim 1, wherein the guiding device comprises a positioning member formed with an outer thread to be screwed in the adjusting member.

* * * * *